United States Patent [19]

Yamada et al.

[11] Patent Number: 4,909,419

[45] Date of Patent: Mar. 20, 1990

[54] PERCUSSION TOOL

[75] Inventors: Toshio Yamada; Keijiro Murayama; Michiaki Adachi, all of Tokyo, Japan

[73] Assignee: Max Co., Ltd., Tokyo, Japan

[21] Appl. No.: 265,840

[22] Filed: Nov. 1, 1988

[30] Foreign Application Priority Data

| | | | |
|---|---|---|---|
| Nov. 5, 1987 | [JP] | Japan | 62-280246 |
| Jul. 28, 1988 | [JP] | Japan | 63-100100[U] |
| Jul. 28, 1988 | [JP] | Japan | 63-100101[U] |
| Jul. 28, 1988 | [JP] | Japan | 63-100102[U] |
| Jul. 28, 1988 | [JP] | Japan | 63-100103[U] |
| Jul. 29, 1988 | [JP] | Japan | 63-101721[U] |

[51] Int. Cl.[4] ..... B25C 1/04

[52] U.S. Cl. ..... 227/1; 227/8; 227/130

[58] Field of Search ..... 227/130, 8, 1; 173/134

[56] References Cited

U.S. PATENT DOCUMENTS

| | | | |
|---|---|---|---|
| 4,030,655 | 6/1977 | Rothfuss et al. | 227/130 |
| 4,483,473 | 11/1984 | Wagdy | 227/8 |

*Primary Examiner*—Paul A. Bell
*Assistant Examiner*—James L. Wolfe
*Attorney, Agent, or Firm*—Cushman, Darby & Cushman

[57] ABSTRACT

A percussion tool of the repeatedly operating type includes a housing, a striking cylinder received in the housing for movement therealong, and a driving piston received in the striking cylinder for movement therealong. The striking cylinder cooperates with the housing to provide a switch valve means which is responsive to the movement of the striking cylinder along the housing for selectively interrupting fluid communication between the interior of the striking cylinder and a discharge port and communicating the interior of said striking cylinder with a compressed air source when the striking cylinder is at its lower position to thereby move the striking piston to cause an associated striking driver to strike a driven element and for selectively interrupting the communication between the interior of the striking cylinder and the compressed air source and communicating the interior of the striking cylinder with the discharge port as the striking cylinder is moved from its lower to upper position. Air within that portion of the interior of the striking cylinder between a lower face of the driving piston and a lower end of the striking cylinder is compressed by the striking piston moving toward an ejecting portion receiving the driven element and is supplied to a return air chamber. The air thus compressed acts on the lower face of the piston to urge the same away from the ejecting portion.

8 Claims, 12 Drawing Sheets

PERCUSSION TOOL

BACKGROUND OF THE INVENTION

1. Field of the Invention

This invention relates to percussion tools or machines for driving nails, rivets or the like.

2. Prior Art

When driving driven elements, such as a nail and a rivet, into a hard material such as concrete, using a nailing machine, the driven element can not often be fully driven into the hard material with one strike or impact. It has therefore been proposed a percussion tool of the type in which a striking piston is continuously moved reciprocally along a cylinder to apply a plurality of impacts to the driven element. In this case, the striking stroke and return stroke of the striking piston alternates with each other. When the striking piston reaches the starting and terminal ends of the stroke or those positions near such stroke ends, the striking piston serves as a switching valve to switch air supply connections, so that compressed air is applied to upper and lower surfaces of the striking piston alternately, thereby reciprocally moving the striking piston continuously.

In the case where the operating stroke of the striking piston is long in the above conventional machine, a driven element sometimes fails to be driven into a hard material a length corresponding to the length of the stroke of the striking piston, particularly where the driven element has a long shank portion. As a result, the switching valve is not switched, so that the striking piston can not be returned.

In addition, in the case where a great impact is caused by the striking action, the housing of the machine is rebounded upwardly due to a reaction encountered, which is undesirable from the viewpoint of operator safety.

Therefore, in the conventional percussion tool, the operating stroke of the striking piston has to be short, and much time is required for driving along driven element. And besides, the operator has to support the tool and moves it in accordance with the amount of driving of the driven element. This is a considerable burden on the part of the operator.

Generally, conventional nailing machines are provided with a nail feed mechanism for automatically feed nails in response to the operation of a striking piston for driving nails. A conventional nail feed mechanism can not be used in the nailing machine of the repeatedly operating type in which the striking piston is reciprocally moved repeatedly to drive one nail. Therefore, in such nailing machines of the repeatedly operating type, there has been used a nail feed mechanism of the type in which the nails are fed manually. One such conventional nail feed mechanism of the manually-operative type is disclosed in Japanese Patent Publication No. 17663/1982. In this nail feed mechanism, a plurality of nails are received in radially-arranged holes in a rotary magazine, and the magazine is rotated by manually operating an operating handle engaged in a groove formed in the periphery of the magazine so as to bring each hole, holding the nail, into alignment with the axis of a striking driver, thus feeding each nail.

With the manually-operative nail feed mechanism, however, a considerable force is required to feed the nails, and both hands have to be used to effect such nail feed operation. Therefore, the hand holding the nailing machine must once be off the machine. This affects the efficiency of the nailing operation.

In addition, the nail feed mechanism employing the rotary magazine can not be charged with many nails, and that portion of the mechanism adjacent to a nail ejecting port is bulky, so that the point of a material into which the nail is to be driven can not be seen clearly. This affects the nailing operation.

To overcome the above difficulties, it is considered to operate the nail feed mechanism, provided with a piston and cylinder device which is driven by compressed air as is the case with the conventional nailing machine, through a manually-operative valve. In this case, however, the nail feed mechanism may be inadvertently operated twice, in which instance two nails are fed to the nail ejecting portion and jammed therein, which adversely affects the nailing operation and may damage the nail ejecting portion and the striking driver.

SUMMARY OF THE INVENTION

It is therefore, a first object of this invention to provide a percussion tool of the repeatedly operating type in which a striking piston can have a long operating stroke regardless of the length of a driven element and of the hardness of a material into which the driven element is to be driven, and an operating cycle is short, and a repeated driving operation can be done at high speed.

A second object is to provide a reaction absorbing mechanism for a percussion tool of the repeatedly operating type which mechanism decreases the amplitude of vibration of the housing due to a reaction of the striking cylinder, thereby alleviating the discomfort of the operator and ensuring the operator safety.

A third object is to provide a reaction absorbing mechanism for a percussion tool of the repeatedly operating type mechanism which enables the operation of the percussion tool by pressing it against a treating material under a small force, and decreases the amplitude of vibration of the housing due to a reaction of the striking cylinder, thereby alleviating the discomfort of the operator and ensuring the operator safety.

A fourth object is to provide a nail feed mechanism which prevents nails from being fed twice and is automatically returned to a condition enabling a subsequent nail feed operation upon completion of a nailing operation of the nailing machine.

A fifth object is to provide a safety mechanism for a nailing machine in which mechanism allows the nailing operation only when the nail is properly fed into the ejecting member, and the nail within the ejecting member is prevented from ejecting from the nail supply port when the nailing machine is operated.

A sixth object is to provide a nail charging mechanism for a nailing machine which facilitates the charging of a bundle of nails into a nail feed passage as well as the removal of the nails therefrom.

According to one aspect of the present invention, there is provided a percussion tool of the repeatedly operating type which comprises:

(a) an elongated housing having at its lower end portion a tubular ejecting portion adapted to receive a driven element; the housing having at its upper end portion a discharge port;

(b) a striking cylinder having upper and lower closed ends and received within the housing for movement therealong between an upper and a lower position, the striking cylinder being spring-urged into its lower position toward the ejecting portion;

(c) a striking piston received within the striking cylinder for sliding movement therealong toward and away from the ejecting portion, the striking piston having a striking driver slidably extending through the lower end of the striking cylinder, the striking driver being extendable into the ejecting portion, the piston having a lower face directed to the ejecting potion, and there being provided a return air chamber disposed between the striking cylinder and the housing and communicating with that portion of the interior of the striking cylinder disposed between the lower face of the striking piston and the lower end of the striking cylinder;

(d) the striking cylinder cooperating with the housing to provide a switch valve means which is responsive to the movement of the striking cylinder along the housing for selectively interrupting fluid communication between the interior of the striking cylinder and the discharge port and communicating the interior of the striking cylinder with a compressed air source when the striking cylinder is at its lower position to thereby move the striking piston to cause the striking driver to strike the driven element and for selectively interrupting the communication between the interior of the striking cylinder and the compressed air source and communicating the interior of the striking cylinder with the discharge port as the striking cylinder is moved from its lower to upper position, and air within the that portion of the interior of the striking cylinder being compressed by the striking piston moving toward the ejecting portion and being supplied to the air chamber, the air thus compressed acting the lower face of the piston to urge the same away from the ejecting portion.

DESCRIPTION OF THE PREFERRED EMBODIMENTS OF THE INVENTION

Figure 1:
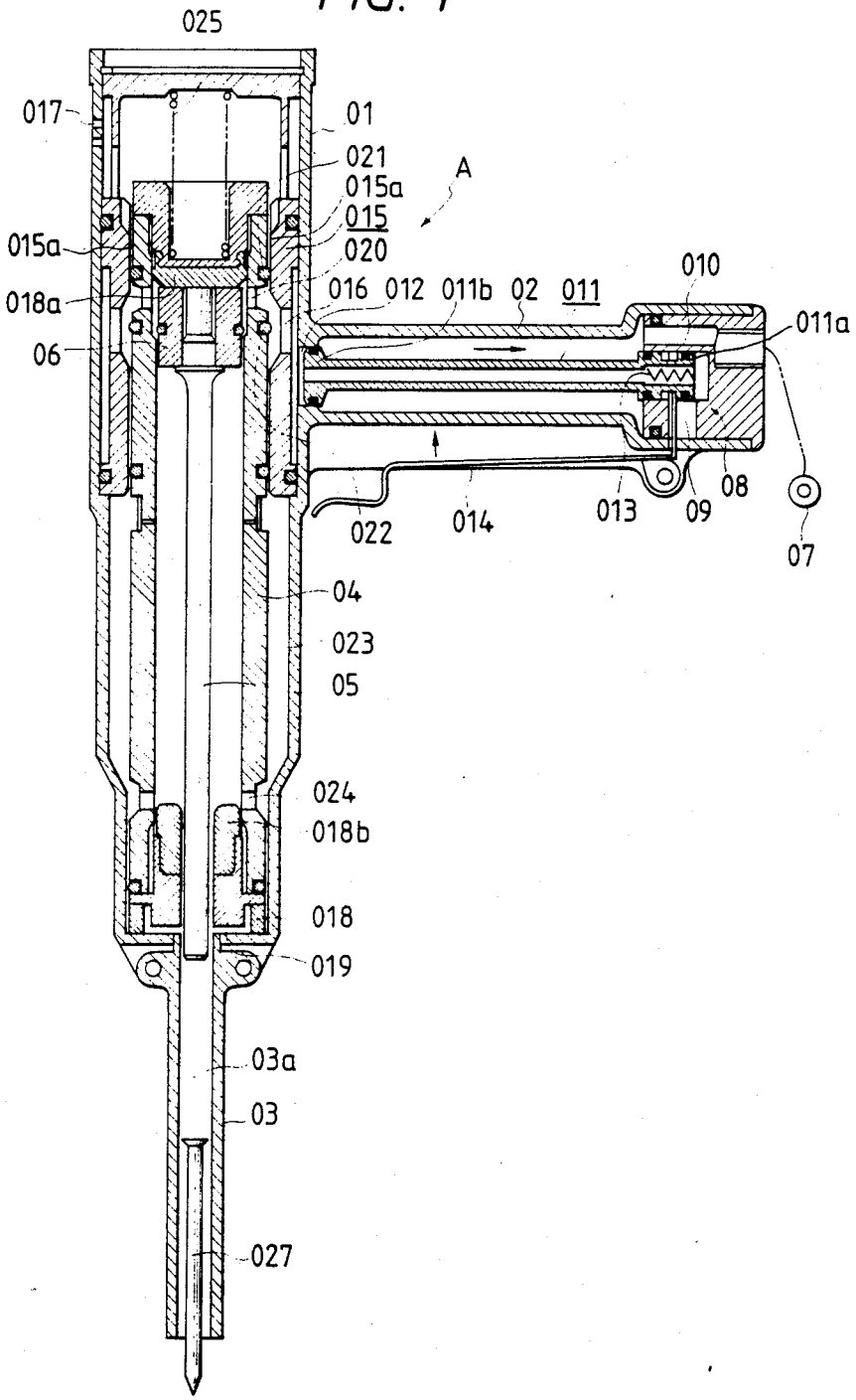
FIG. 1 is a vertical cross-sectional view of a percussion tool according to a first embodiment of the present invention.

A first embodiment of the invention will now be described with reference to FIGS. 1 and 2.

In these Figures, reference character A denotes a percussion tool of the repeatedly operating type. The percussion tool A comprises a housing 01 which has a grip portion 02 on one side thereof, and an integral ejecting portion 03 of a tubular shape at a lower end portion of the housing. A striking cylinder 04 is housed in the housing 01 for sliding movement therealong. A striking piston 06 to which a striking driver 05 is integrally connected is slidably received in the striking cylinder 04. The outer periphery of the striking cylinder 04 and the inner periphery of the housing 01 cooperate with each other to switch the supply and discharge of compressed air in accordance with the sliding movement of the striking cylinder 04, so that the striking piston 06 is reciprocally moved to drive a driven element 027 received in an ejecting bore 03*a* of the ejecting portion 03.

The grip portion 02 is of a hollow construction and has one end connected to an air supply source 07. A trigger valve mechanism 08 is received within the grip portion 02.

The trigger valve mechanism 08 comprises a tubular valve member 011 having an outer end 011*a* slidably received in a valve cylinder 010 having an air discharge port 09. An inner end 011*b* of the valve member 011 is slidably received in an air supply opening 012 formed through the side wall of the housing 01. The valve member 011 is urged by a spring 013 in such a manner that the outer periphery of the valve member 011 closes the air supply opening 012 and that the interior of the valve member 011 is in communication with the air discharge port 09. A trigger lever 014 is angularly movably mounted on the grip portion 02 and is engaged with the outer end 011*a* of the valve member 011. Normally, the valve member 011 closes the air supply opening 012 under the influence of the spring 013, and the interior of the housing 01 communicates with the air discharge port 09 through the interior of the valve member 011, as shown in FIG. 1. The trigger lever 014 is triggered to move the valve member 011 to open the air supply opening 012 to communicate the interior of the housing 01 with the air supply source 07. The valve member 011 thus moved also closes the air discharge port 09.

A sleeve 015 is mounted on the inner peripheral surface of the housing 01 and has apertures 016 formed therethrough, the apertures 016 communicating with the air supply source 07 via the air supply opening 012 of the housing 01. The housing 01 has discharge ports 017 at its upper end portion. A bumper 018 is mounted on the inner peripheral surface of the housing 01 at its lower end portion.

The upper end of the striking cylinder 04 is closed, and the striking cylinder 04 has at its lower portion a guide hole 019 for guiding the movement of the striking driver 05. Bumpers 018*a* and 018*b* are mounted on the inner peripheral surface of the striking cylinder 04 at its upper and lower ends, respectively. Air supply and discharge ports 020 are formed through the striking cylinder 04 at its upper portion. Sealing O-rings 021 and 022 are mounted on the outer periphery of the striking cylinder 04 and disposed on opposite sides of the air supply and discharge ports 020.

A return air chamber 023 is formed around the lower portion of the outer periphery of the striking cylinder 04, that is, formed between the housing 01 and the striking cylinder 04. The striking cylinder 04 has apertures 024 through which the air is supplied to the lower surface or face of the striking piston from the return air chamber 023.

A spring 025 acts between the upper end of the housing 01 and the upper end of the striking cylinder 04 to normally urge the striking cylinder 04 toward the ejecting portion 03 (i.e., toward the lower dead point).

A switching valve means is formed by the outer periphery of the striking cylinder 04 and the inner periphery of the sleeve 015.

With this switching valve means, the outer periphery of the striking cylinder 04 and the inner periphery 015*a* of the sleeve 015 cooperate with each other to selectively communicate the interior of the striking cylinder 04 with the air supply source 07 and with the air discharge port 017 in accordance with the sliding movement of the striking cylinder 04. When the striking cylinder 04 is at its lower dead point as shown in FIG. 1, the upper O-ring 021 is held in contact with the inner periphery 015*a* of the sleeve 015 while the lower O-ring 020 is out of contact therewith, so that the air discharge port 017 does not communicate with the striking cylinder 04. And, in this condition, when the trigger valve mechanism 08 is operated to open the air supply opening 012, the air supply and discharge port 020 communicates with the air supply source 07 via the apertures 016.

Figure 2:
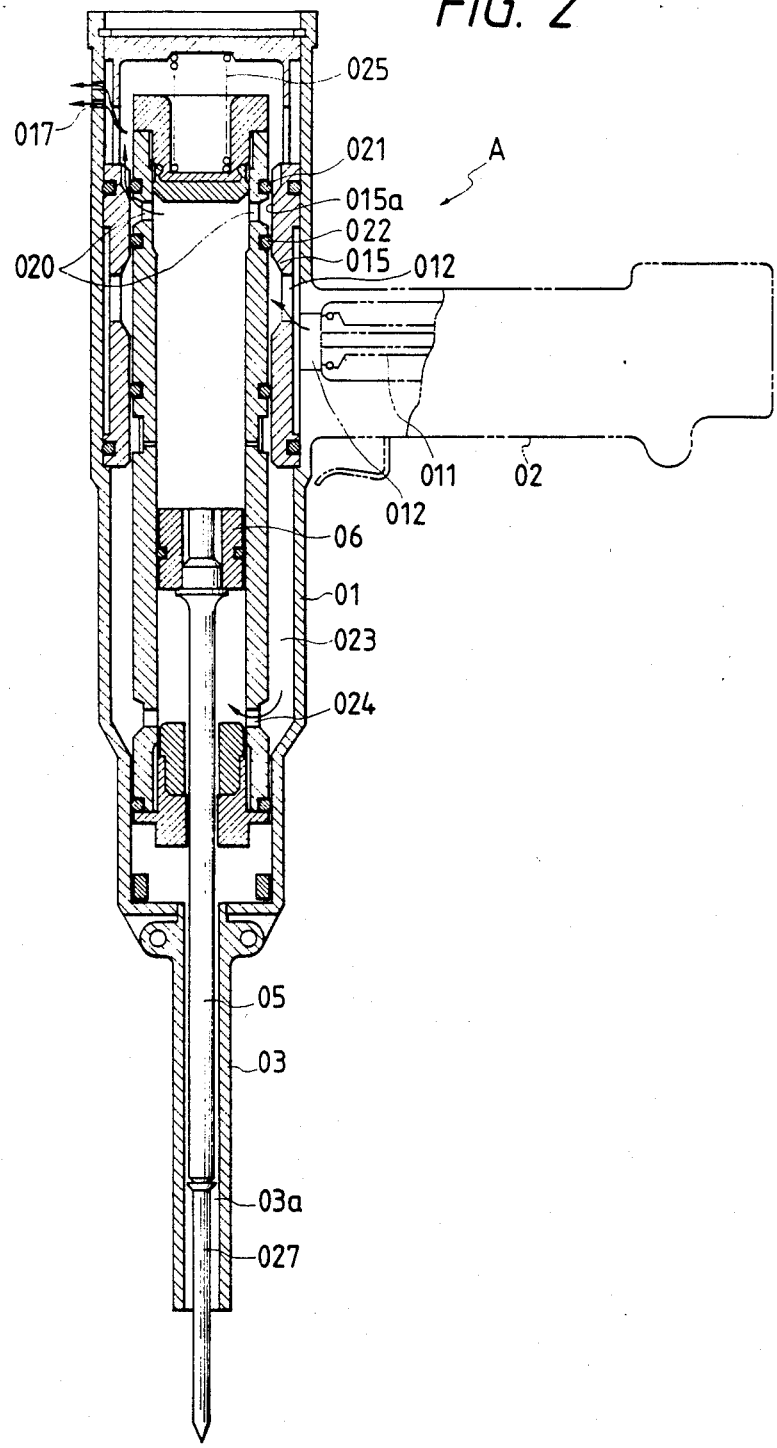
FIG. 2 is a view generally similar to FIG. 1 showing the operation of the percussion tool.

On the other hand, as the striking cylinder 04 moves from its lower dead point toward its upper dead point as shown in FIG. 2, the lower O-ring 020 is also brought into contact with the inner periphery 015*a* of the sleeve 015 while the upper O-ring 021 is brought out of engagement with the inner periphery 015*a*, so that the air supply and discharge ports 020 are shut off relative to the apertures 016 but communicates with the air discharge port 017.

The operation of the percussion tool A of the repeatedly operating type mentioned above will now be described.

First, the driven element 027 is charged into the ejecting bore 03*a*. In this condition, as shown in FIG. 1, the striking piston 06 is positioned at its upper dead point while the striking cylinder 04 is positioned at its lower dead point, and the upper O-ring 021 is held in contact with the inner peripheral 015*a* of the sleeve 015. Therefore, the striking cylinder 04 does not communicate with the air discharge port 017, and the air supply and discharge ports 020 communicates via the apertures 016 with the air supply opening 012 leading to the grip portion 02. And, the air supply opening 012 is closed by the trigger valve mechanism 08.

When the driven element 027 is to be driven, the front end of the ejecting portion 03 is brought into engagement with a surface of a material (not shown; hereinfater referred to as "treating material") to which the driven element 027 is to be applied. Then, the trigger lever 014 is manipulated into its operative position to operate the trigger valve mechanism 08 to move the tubular valve member 011 to open the air supply opening 012, so that the striking cylinder 04 communicates with the air supply source 07. As a result, the compressed air is abruptly supplied to the upper face or surface of the striking piston 06 within the striking cylinder 04 via the air supply opening 012, the apertures 016 of the sleeve 015 and the air supply and discharge ports 020, so that the striking piston 06 is driven to move downwardly, and at the same time the striking cylinder 04 is driven to move upwardly due to a reaction force encountered.

Upon the downward movement of the striking piston 06 thus driven, the striking driver 05 is moved along the ejecting bore 03*a* and strikes the driven element 027 with an impact, thereby driving the driven element 027 into the treating material. As the striking piston 06 is moved toward its lower dead point, the air disposed below the striking piston 06 is compressed, and part of the thus compressed air is fed via the apertures 024 of the striking cylinder 04 to the return air chamber 023 and stored therein. Then, when the striking piston 06 is stopped, the compressed air within the return air chamber 023 is supplied to the lower face of the striking piston 06 via the apertures 024.

On the other hand, the striking cylinder 04 thus driven continues to move upwardly from its lower dead point to its upper dead point at a predetermined speed because of the introduced compressed air. At this time, the lower O-ring 022 is brought into contact with the inner periphery 015*a* of the sleeve 015 while the upper O-ring 021 becomes disengaged from the inner periphery 015*a*, so that the air supply and discharge ports 020 of the striking cylinder 04 is shut off relative to the apertures 016 and communicates with the air discharge port 017. Due to this switching operation, the compressed air supplied to the upper surface of the striking piston 06 is discharged through the air supply and discharge ports 020 and the air discharge port 017 (see FIG. 2). As a result, the pressure within the striking cylinder 04 is reduced, and the pressure of the compressed air, supplied from the return air chamber 023 to the lower face of the striking piston 06 which is stationary at this time, becomes greater than the pressure within the striking cylinder 04, so that the striking piston 06 is moved upwardly toward its upper dead point due to a pressure differential across it. During that time, although the striking cylinder 04 tends to move upwardly by inertia after the valve switching operation, this movement is attenuated by the urging force of the spring 025 and is caused to stop at it upper dead point. Then, when the pressure within the striking cylinder 04 is reduced due to the air discharge, the urging force of the spring 025 urging the striking cylinder 04 toward the ejecting portion 03 becomes greater. As a result, the striking cylinder 04 is caused to move toward its lower dead point and stop there, and is again engaged with the upper face of the striking piston 06 at the initial position to switch the air connections.

If the trigger lever 014 is held in its operative position, the air supply opening 012 remains open by means of the trigger valve mechanism 08, so that the compressed air is again supplied into the striking cylinder 04. As a result, the striking piston 06 and the striking cylinder 04 are driven to move in the opposite directions to repeat the abovementioned operation. Therefore, if the driving of the driven element 027 is not completed by one striking operation, the striking piston 06 is repeatedly operated at a short cycle at high speed to fully drive the driven element, if the trigger lever 014 is held in its operative position.

When the finger is disengaged from the trigger lever 014, the compressed air is not supplied to the striking cylinder 04 from the air supply source 07, so that the striking cylinder 04 and the striking piston 06 are stopped at their initial positions shown in FIG. 1

As described above, with the percussion tool A, the switching of the supply and discharge of the compressed air relative to the striking cylinder 04 is determined depending on the time required for one stroke of the striking cylinder 04. This is determined based on the mass of the striking cylinder 04, the spring force of the spring 025, the pressure of the compressed air, the friction between the housing 01 and the striking cylinder 04, etc., and has nothing to do with the hardness of the treating material into which the driven element 027 is to be driven, the length of the driven element 027, the stroke of the striking piston 06, etc. More specifically, the compressed air is switched in accordance with the movement of the striking cylinder 04, and the striking piston 06 operates in accordance with the switching of the compressed air. Therefore, even if the driven element 027 is not fully driven into the treating material because the treating material is too hard, and if the driven element 027 is too long, so that the striking piston 06 does not achieve the predetermined stroke and is stopped halfway, the striking cylinder 04 continues to slidingly move regardless of such situation and achieves the predetermined stroke and cooperates with the inner periphery of the housing 01 to switch the connections of the compressed air. Therefore, in accordance with this switching operation, the striking piston stopped 06 halfway during its stroke is returned to its upper dead point. Therefore, the stroke of the striking piston 06 can be made long, and in addition the operation can be repeatedly carried out at a short cycle at high speed, which enables the driving of the driven element 027 in a short time.

Further, when driving the driven element 027, the striking cylinder 04 and the striking piston 06 are moved in the opposite directions at the same time, so that the reaction of the striking piston 06 is not transmitted to the housing 01. Therefore, the handling and operability are enhanced.

Further, since the air is switched by means of the stroke of the striking cylinder 04, no switching valve is needed. Therefore, the construction is simplified and is less subjected to malfunction.

With the above construction, when the compressed air is supplied into the striking cylinder 04 in the lower position (lower dead point) of the striking cylinder 04, the striking cylinder 04 disposed at its lower dead point and the striking piston 06 disposed at its upper dead point are simultaneously moved in the opposite directions. As the striking cylinder 04 slidingly moves toward its upper dead point at a constant speed, the striking cylinder 04 is attenuated by the urging force urging it toward the ejecting portion 03, and is stopped at its upper dead point. At this time, the connection of the compressed air to the striking cylinder 04 is switched, so that the compressed air is discharged from the striking cylinder 04. As a result, the striking cylinder 04 slidingly moves in the opposite direction by the urging force urging it toward the ejecting portion 03 and is stopped at its lower dead point, thus completing one stroke of movement. At this time, the connection of the compressed air is again switched.

The striking piston 06 is stopped after the striking driver 05 strikes the driven element 13 within the ejecting portion 03. At this time, the air compressed by the downwardly-moving striking piston 06 and fed to the return air chamber 023 through the apertures 024 is applied to the lower face of the striking piston 06. When the striking cylinder 04 reaches its upper dead point, so that the connection of the compressed air is switched, the air pressure acting on the upper face of the striking piston 06 becomes smaller. As a result, due to a pressure differential across the striking piston 06, the striking piston 06 is returned to its upper dead point.

When the striking cylinder 04 is returned to its lower dead point, the connection of the compressed air is again switched as described above, so that the compressed air is again supplied into the striking cylinder 04, thereby repeatedly moving the striking cylinder 04 and the striking piston 06 in the opposite directions in the manner mentioned above. In this manner, the supply and discharge of the compressed air are switched by one stroke of sliding movement of the striking cylinder 04.

Incidentally, in the first embodiment of the invention described above, as a result of the upward movement of the striking cylinder 04, reaction is transmitted to the housing 01 through the urging spring 025. This reaction develops since the upper end of the upwardly-moving striking cylinder 04 compresses the urging spring 025 to the maximum degree whereas the load at the lower end of the striking cylinder 04 becomes zero, so that a great load change is encountered. More specifically, if the weight of the striking cylinder 04 is not taking into account, during the time when the striking cylinder 04 is moved from its lower to upper position (i.e., lower dead point to upper dead point), the housing 01 is subjected to the load of zero to the maximum level. In contrast, during the time when the striking cylinder 04 is moved from its upper to lower position, the housing 01 is subjected to the load of the maximum lever to zero.

The urging spring 025 even in its fully extended condition urges downwardly the striking cylinder 04 disposed at its lower dead point, and its mounting load is applied to the housing 01. Therefore, the moment the striking cylinder 04 leaves the bottom of the housing 01, the load applied to the housing 01 due to the reaction abruptly rises from zero to the mounting load of the urging spring 025. In contrast, the moment the striking cylinder 04 strikes against the bottom of the housing 01 as a result of the expansion of the urging spring 025, the load applied to the striking cylinder 04 abruptly drops from the mounting load of the urging spring to zero.

To resist such reaction to prevent the percussion tool from leaving from the surface of the treating material, the operator must press the tool against the treating material with a great force. The change in load due to the abovementioned reaction imparts vibration to the hand of the operator holding the housing. This vibration is very great as indicated in a broken line in FIG. 6, and therefore gives an uncomfortable feeling to the operator and may injure the operator.

A second embodiment of the invention seeks to provide a reaction absorbing mechanism for a percussion tool of the repeatedly operating type which mechanism overcomes the above difficulties. The second embodiment of the invention will now be described with reference to FIGS. 3A and 4 to 6.

Figure 3A:
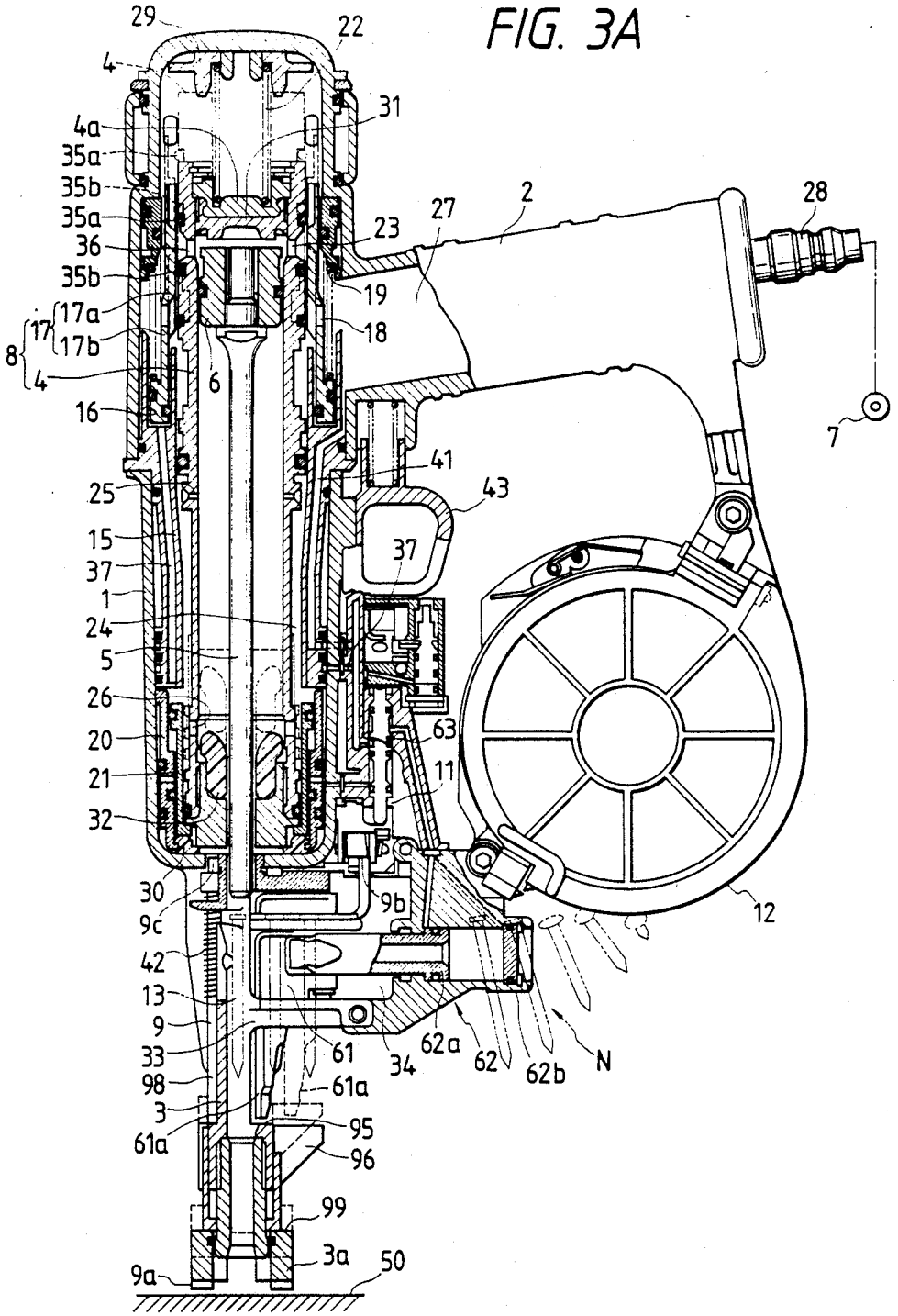
FIGS. 3A and 3B are views similar to FIG. 1 but showing a second to a sixth embodiments of the invention.

FIG. 3A is a cross-sectional view of a nailing machine of the repeatedly operating type. The nailing machine comprises a housing 1 which has a grip portion 2 at its one side and a tubular ejecting member 3 secured to its lower end. A movable cylinder 4 received within the housing 1 so as to be reciprocally movable therealong upwardly and downwardly. The cylinder 4 is spring-biased downwardly. A striking piston 6 is received within the movable cylinder 4 so as to be reciprocally movable therealong upwardly and downwardly. The piston 6 has a striking driver 5 integrally connected thereto and slidingly movable in the ejecting member 3. An automatic switch valve means 8 is provided for selectively connecting the interior of the movable cylinder 4 to a compressed air source and to the atmosphere in accordance with the reciprocal movement of the movable cylinder 4. A contact member 9 is so urged that its lower end projects downwardly from a lower end of the ejecting member 3. A trigger mechanism 11 operates the automatic switch valve means 8 by the contact member and a hand-operated trigger 43. A magazine 12 is provided between the ejecting member 3 and the grip portion 2. The supply of the compressed air to the movable cylinder 4 and the discharge of the compressed air therefrom are repeated so as to drive the striking piston 6 repeatedly so that the striking driver 5 repeatedly strikes a nail 13, supplied to the ejecting member 3 from the magazine 12, to thereby drive the nail 13.

Each portion of the above nailing machine will now be described in more detail.

The housing 1 is of a tubular construction, dampers 29 and 30 are mounted on the inner surfaces of the upper and lower ends of the housing 1. A tubular sleeve 15 is mounted within the housing 1 intermediate the opposite ends thereof.

An upwardly-opening annular receptive portion 16 is formed in the upper end portion of the sleeve 15. A head valve 17 is received in the receptive portion 16 so as to be movable upwardly and downwardly. An upper portion **17*a* of the head valve 17 is smaller in diameter than its lower portion 7*b*. Compressed air supply ports 18 for connecting the movable cylinder 4 to the grip portion 2 are formed through the lower portion 17*b* of a greater diameter. The head valve 17 is urged downwardly by a spring 19** and air pressure.

A sleeve guide 20 is mounted within the housing 1 below the sleeve 15, and a movable sleeve 21 is received in the sleeve guide 20 so as to be movable upwardly and downwardly.

The movable cylinder 4 slidably extends through the sleeve 15 and is reciprocally movable between an upper position (upper dead point) where its upper end is in contact with the upper damper 29 and a lower position (lower dead point) where its lower end is in contact with the lower damper 30. A spring 22 acts between the upper end of the housing 1 and a head potion **4*a* of the movable cylinder 4. The spring 22 normally urges the movable cylinder 4 downwardly into its lower dead point, and the deformation or compression of the spring 22 varies from its minimum to maximum value in accordance with the movement of the movable cylinder 4. Air supply and discharge ports 23 are formed through the peripheral wall of the movable cylinder 4 adjacent to its upper end. Apertures 25 and apertures 26 are formed through the peripheral wall of the movable cylinder 4 intermediate the opposite ends and at its lower portion, respectively. The interior of the movable cylinder 4 communicates via these apertures 25 and 26 with a return air chamber 24 formed between the movable cylinder 4 and the sleeve 15. Dampers 31 and 32 are mounted on the movable cylinder 4 adjacent to its upper and lower ends, respectively. The striking piston 6 is reciprocally movable between an upper position where its upper face is in contact with the upper damper 31 and a lower position where its lower face is in contact with the lower damper 32. The movable cylinder 4 and the striking piston 6** constitute a striking mechanism.

The grip portion 2 is of a hollow construction and has an air chamber 27 therein. Attached to the distal end of the grip portion 2 is a fitting 28 to which an air hose connecting to an compressed air source 7 is connected.

The ejection member 3 serves to guide the sliding movement of the striking driver 5 extended from the housing 1, and has a nail supply port 33 at one side for receiving nails N from the magazine 12.

The magazine 12 houses a bundle of nails formed into a helical shape, and a nail feed passage 34 for passing the bundle of nails N extends between the magazine 12 and the nail supply port 33 of the ejecting member 3. A feed mechanism for feeding the bundle of nails N is provided in the nail feed passage 34.

The automatic switch valve means 8 is constituted by the head valve 17 and the movable cylinder 4, and automatically switches the supply of the compressed air into the movable cylinder 4 and the discharge of the compressed air therefrom in accordance with the reciprocal movement of the movable cylinder 4, thereby reciprocally moving the movable cylinder 4 and the striking piston 6 repeatedly. More specifically, upper and lower O-rings **35*a* and 35*b* are mounted on the outer periphery of the movable cylinder 4 on opposite sides of the air supply and discharge ports 23. The upper and lower O-rings 35*a* and 35*b* are adapted to be in contact with a contact surface 36 formed on the inner periphery of the smaller-diameter portion 17*a* of the head valve 17**.

With the above construction, when the head valve 17 is moved upwardly relative to the movable cylinder 4, the lower O-ring **35*b* is disengaged from the contact surface 36 of the smaller diameter portion 17*a* of the head valve whereas the upper O-ring 35*a* is engaged with the contact surface 36. As a result, the interior of the movable cylinder 4 communicates with the compressed air source 7 via the air supply and discharge ports 23, the compressed air supply ports 18 and the air chamber 27 of the grip portion 2. Therefore, the compressed air is abruptly supplied into the movable cylinder 4, so that the striking piston 6 is driven downwardly, and at the same time due to its reaction, the movable cylinder 4 is driven upwardly against the bias of the spring 22**.

When the movable cylinder 4 is moved upwardly, the upper O-ring **35*a* is disengaged from the contact surface 36 of the smaller diameter portion 17*a* of the head valve 17, and at the same time lower O-ring 35*b* is engaged with the contact surface 36, so that the air supply and discharge ports 23 of the movable cylinder 4 communicates with the atmosphere, thereby discharging the compressed air, supplied into the movable cylinder 4, to the atmosphere. Thus, the supply and discharge of the compressed air with respect to the interior of the movable cylinder 4 are automatically switched, and the air pressure acting on the lower face of the head 4*a* of the movable cylinder 4 is reduced, so that the movable cylinder 4 is moved downwardly under the influence of the spring 22. When the movable cylinder 4 is moved downwardly, the supply and discharge of the compressed air are automatically switched again, as described above, so that the movable cylinder 4 is automatically moved upwardly again. In this manner, the movable cylinder 4** is reciprocally moved upwardly and downwardly repeatedly.

When the movable cylinder 4 is driven upwardly upon supplying of the compressed air into the movable cylinder 4, the striking piston 6 is driven downwardly. At this time, the air compressed by the lower face of the thus downwardly-moving striking piston 6 is supplied to the return air chamber 24 through the apertures 25 and 26 and stored therein. When the compressed air within the movable cylinder 4 between its upper end and the striking piston 6 is discharged, the pressure acting on the upper face of the striking piston 6 becomes less that the pressure applied from the return air chamber 24 through the apertures 26 and acting on the lower face of the striking piston 6. As a result, the striking piston 6 is moved upwardly. In this manner, the automatic switch valve means 8 automatically operates in accordance with the reciprocal movement of the movable cylinder 4, and at the same time, the striking piston 6 and the movable cylinder 4 are reciprocally moved in the opposite directions repeatedly, so that the nail 13 in the ejecting member 3 is repeatedly struck by the striking driver 5, thereby driving the nail 13 into a treating material 50.

As described above, the operation of the automatic switch valve means 8 is automatically started by the upward movement of the head valve 17, and the head valve 17 is upwardly moved through the operation of the trigger mechanism 11.

Figure 4:
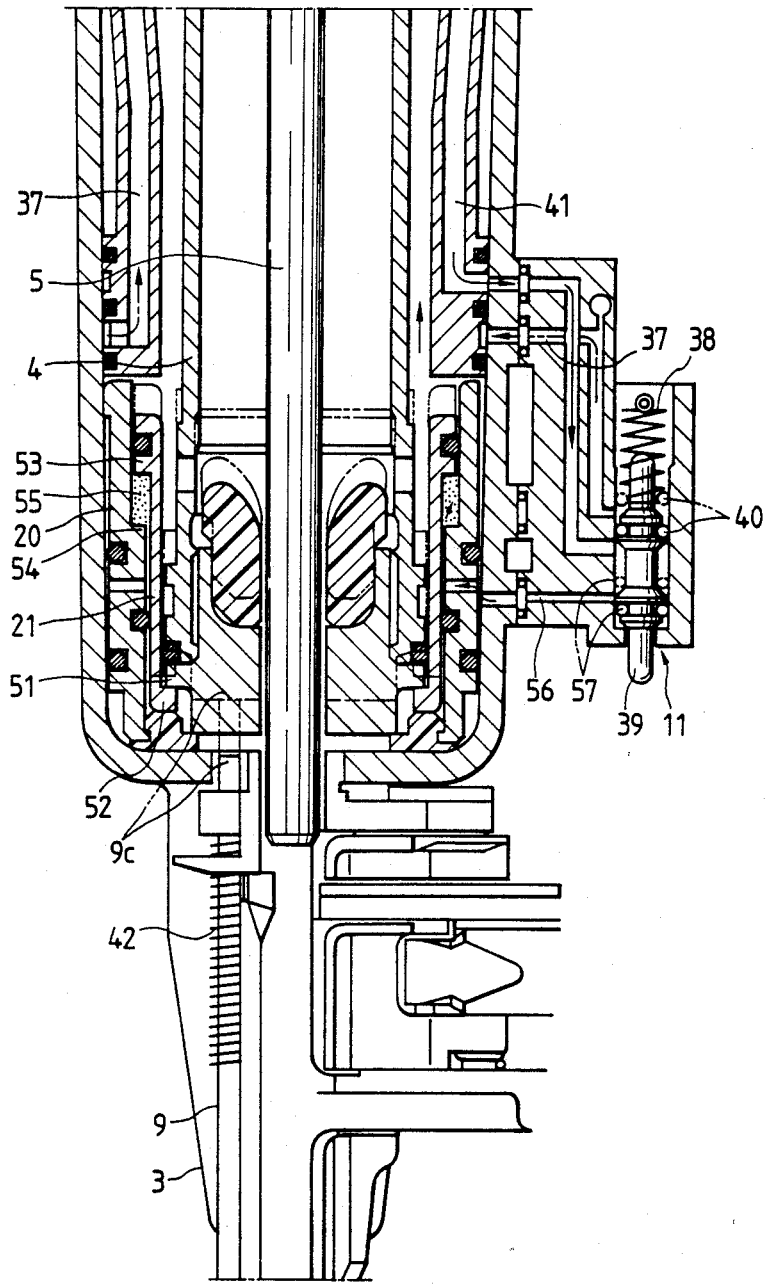
FIG. 4 a fragmentary cross-sectional view, showing a pneumatic circuit of a third and a fourth embodiment.

The trigger mechanism 11 is in the form of a trigger valve. The trigger valve 11 selectively connects an air passage 37, opening to the lower end of the annular receptive portion 16 of the head valve 17, to the atmosphere and to the air chamber 27 of the grip portion 2. As shown in FIG. 4, the trigger valve 11 is normally urged by a spring 38 so as to communicate the air passage 37 with the atmosphere. When a trigger valve stem 39 is pushed against the bias of the spring 38, an O-ring 40 mounted around the valve stem 39 is so displaced as to communicate the air passage 37 with an air passage 40 leading to the air chamber 27 of the grip portion 2.

When the air passage 37 opens to the atmosphere, the head valve 17 is held in its lower position, as indicated by a solid line in FIG. 3A, by the air pressure and the force of the spring 19. Upon pushing of the trigger valve stem 39, the trigger valve 11 is operated, so that the head valve 17 is moved upwardly against the bias of the spring 19 into an upper position as shown in a dot-and-dash line, thereby operating the automatic switch valve means 8.

The operation of the trigger mechanism 11 is enabled only by upward pushing of the contact member 9 and a manipulation of a contact lever 10. The contact member 9 is slidably mounted along the ejecting member 3, and is urged by a spring 42 so that its lower end **9*a* is extended from the lower end of the ejecting member 3. The contact member 9 is branched halfway so that one upper end 9*b* thereof is disposed in opposed relation to the contact lever 10 whereas the other upper end 9*c* is engageable with the movable cylinder 4**.

Figure 5:
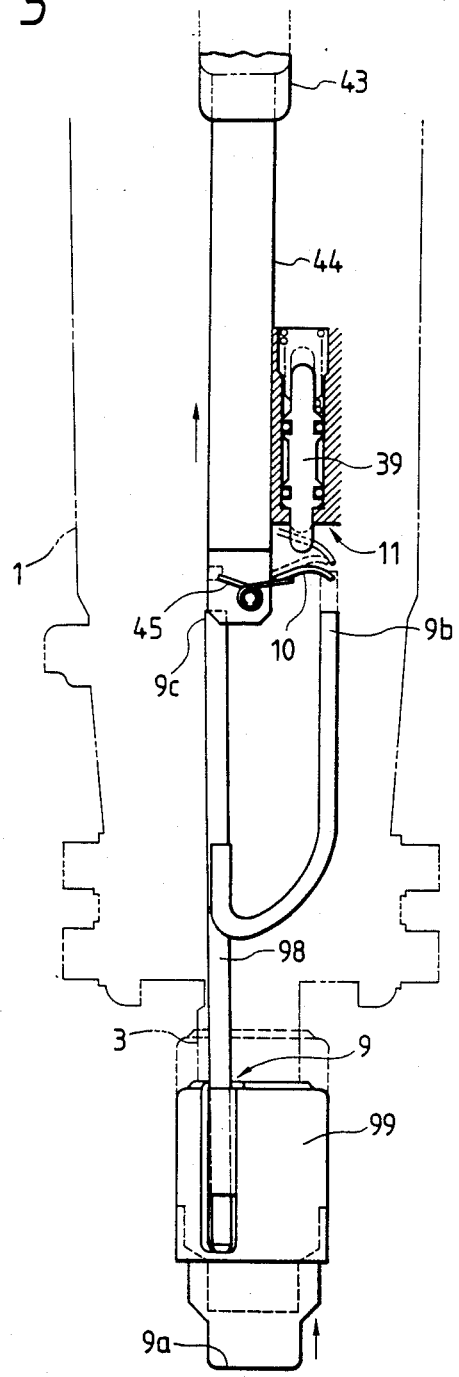
FIG. 5 is a schematic view showing a trigger mechanism and a reaction absorbing mechanism according to the 3rd to 5th embodiments.

As shown in FIG. 5, the contact lever 10 is pivotally connected to a lower end of an extension lever 44 extending downwardly from the trigger 43 formed on the proximal end portion of the grip portion 2. The trigger valve stem 39 is disposed in opposed relation to the central portion of the contact lever 10, and the distal end of the contact lever 10 is disposed in opposed relation to the upper end **9*b* of the contact member 9. The contact lever 10 is biased by a spring 45** having a small force in such a manner that the distal end portion of the contact lever is directed upwardly.

With the above construction, when the lower end of the ejecting member 3 is pressed against the surface of the treating material 50, the contact member 9 is moved upwardly relative to the housing 1, so that the upper end **9*b* of the contact member 9 is brought into engagement with the distal end of the contact lever 10. Then, when the trigger 43 is moved upwardly, the central portion of the contact lever 10 is also moved upwardly to push the valve stem 39 upwardly, so that the trigger mechanism 11** is operated as described above.

The nailing machine of the above construction further comprises a reaction absorbing mechanism for absorbing a reaction of the movable cylinder 4. The reaction absorbing mechanism is constituted by the contact member 9. More specifically, the upper end **9*c* of the contact member 9 is extendable through the housing 1 so as to be opposed to the lower end of the movable cylinder 4. When the lower end of the contact member 9 is pressed against the treating material 50, the contact member 9 is moved upwardly relative to the housing 1, so that the upper end 9*c* is brought into engagement with the lower end of the movable cylinder 4 to space the movable cylinder 4 away from the lower end of the housing 1**.

When the nailing machine is to be operated, first, the contact member 9 is brought into engagement with the treating material 50, so that the contact member 9 is moved upwardly relative to the housing 1. As a result, part of the contact member 9 is extended into the housing 1, as shown in FIG. 4, and the upper end **9*c* upwardly pushes the movable cylinder 4 disposed at its lower dead point so as to space the movable cylinder 4 away from the housing 1. Therefore, an upwardly-acting force, corresponding to the mounting load of the spring 22 downwardly urging the movable cylinder 4 disposed at its lower dead point, acts on the housing 1. Therefore, then, in the subsequent repeated operation of the nailing machine, when the movable cylinder 4 is upwardly moved during the time when the compression of the spring 22 varies from its minimum to maximum value, the housing 1 is subjected to the reaction force corresponding to the force gradually increasing from the mounting load of the spring 22** (the load at the time of the minimum compression) to the maximum load (the load at the time of the maximum compression).

In contrast, when the movable cylinder 4 is moved downwardly, the lower end of the movable cylinder 4 is brought into engagement with the contact member 9 near its lower limit of movement. If the contact member 9 is not provided, from this time to the time when the lower end of the movable cylinder 4 is brought into engagement with the lower end of the housing 1, the reaction force of to from the mounting load of the spring 22 to zero acts on the housing 1. Therefore, due to the engagement of the lower end of the movable cylinder 4 with the contact member 9, the treating material 50 bears the above reaction load through the contact member 9, so that the reaction force corresponding to the force gradually decreasing from the maximum load of the spring to the mounting load acts on the housing 1. Thus, the reaction force exerted on the housing 1 will not become zero, and therefore the vibration resulting from it is represented as indicated in a solid line in FIG. 6. Therefore, the amplitude of the vibration imparted to the operator becomes small, and the discomfort and operating feeling of the operator can be greatly improved.

In the second embodiment described above, the contact member 9 is adapted to be engaged with the movable cylinder 4 so that the urging force urging the movable cylinder 4 is supported by the treating material 50 through the contact member 9. In this case, however, the rebounding force due to the initial mounting load of the urging spring 22 acts on the housing 1. Therefore, before the nail 13 is to be driven into the treating material 50, the machine must be pressed against the treating material 50 to resist such rebounding force. This is rather cumbersome since there are occasions when the footing on which the operator stands is not so stable.

A third embodiment of the invention seeks to provide a reaction absorbing mechanism for a percussion tool of the repeatedly operating type which mechanism overcomes the above difficulties.

The third embodiment of the invention will now be described with reference to FIGS. 3 to 6. The main construction and operation of the third embodiment are the same as those of the second embodiment, and therefore explanation thereof will be omitted. And, the same parts will be denoted by the same reference numerals.

A nailing machine according to the third embodiment includes a reaction absorbing mechanism for absorbing the reaction of a movable cylinder 4. The construction of the reaction absorbing mechanism will now be described. Part of the contact member 9 is branched off and is extended into the housing 1, this part being disposed in opposed relation to the lower end face of the movable cylinder 4. When the lower end 9*a* of the contact member 9 is pressed against the surface of the treating material 50, the upper end 9*c* of the contact member 9 is moved upwardly relative to the housing 1 so that the upper end 9*c* engages the lower end face of the movable cylinder 4 to space the lower end of the movable cylinder 4 from the housing 1. At the same time, a pneumatically-operated mechanism is provided in the housing 1 so as to raise the lower end of the movable cylinder 4 to the upper dead point of the contact member 9, the contact member 9 being moved to its upper dead point upon pressing against the treating material 50.

The pneumatically-operated mechanism will now be described with reference to FIG. 4. The movable sleeve 21 has at its lower end an engaging portion 52 which is engageable with a lower surface of a projection 51 formed on the outer periphery of the movable cylinder 4 adjacent to its lower end. The movable sleeve 21 also has an annular projection 53 formed on the outer periphery thereof adjacent to its upper end. The sleeve guide 20 has an annular projection or shoulder 54 formed on the inner periphery thereof intermediate the opposite ends thereof. A space 55 is defined by the lower surface of the annular projection 53, the inner peripheral surface of the guide sleeve 20, the outer peripheral surface of the movable sleeve 21 and the upper surface of the annular projection 54. The compressed air is supplied to and discharged from the space 55 so that the space is expanded and contracted so as to move the movable cylinder 4 upwardly and downwardly.

An air passage 56 leading to the space 55 is selectively connected to the air chamber 27 and to the atmosphere through the trigger valve 11. The air passage 56 is normally connected to the compressed air source 7 via the air chamber 27. Upon actuation of the trigger valve 11, the lower O-ring 57 moves past the air passage 56 to connect the air passage 56 to the atmosphere.

With the above reaction absorbing mechanism, before the nailing machine is operated, the compressed air is supplied to the pneumatically-operated mechanism, so that the space 55 is in its expanded condition, and the movable sleeve 21 is in its upper position, so that the the lower end of the movable cylinder 4 is raised to the upper position or upper dead point of the contact member 9. The compressed air force serving to space the movable cylinder 4 from the housing 1 is equal to the mounting load of the spring 22. In this manner, the movable cylinder 4 has already been moved upwardly before the nailing machine is operated, and therefore the force required to press the contact member 9 against the surface of the treating material 50 when the nailing machine is to be operated is small.

When the trigger valve 11 is operated to operate the nailing machine, the air passage 56 is caused to communicate with the atmosphere to contract the space 55, so that the lower end of the movable cylinder 4 is lowered into contact with the upper end 9*c* of the contact member 9 and does not contact the housing 1.

Therefore, when the nailing machine is operated, the movable cylinder 4 is moved upwardly, so that the compression of the spring 22 varies from its minimum to maximum value, the reaction force of from the mounting load (minimum compression) of the spring 22 to the maximum load (maximum spring compression) is exerted on the housing in a gradually increasing manner.

In contrast, when the movable cylinder 4 is moved downwardly, the lower end of the movable cylinder 4 is brought into contact with the contact member 9 near the lower dead point of the movable cylinder 4. If there is not provided the contact member 9, from this time to the time when the lower end of the movable cylinder 4 is brought into engagement with the lower end of the housing 1, the reaction force of from the mounting load of the spring 22 to zero acts on the housing 1. Therefore, by engagement of the lower end of the movable cylinder 4 with the contact member 9, the above reaction load is borne by the treating material 50 through the contact member 9. Therefore, the reaction force of from the maximum load to the mounting load acts on the housing in a gradually decreasing manner.

Figure 6:
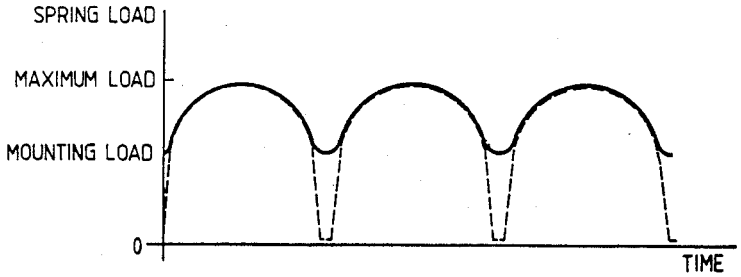
FIG. 6 is a diagrammatical illustration showing vibration characteristics in the 1st to 3rd embodiments.
Figure 8:
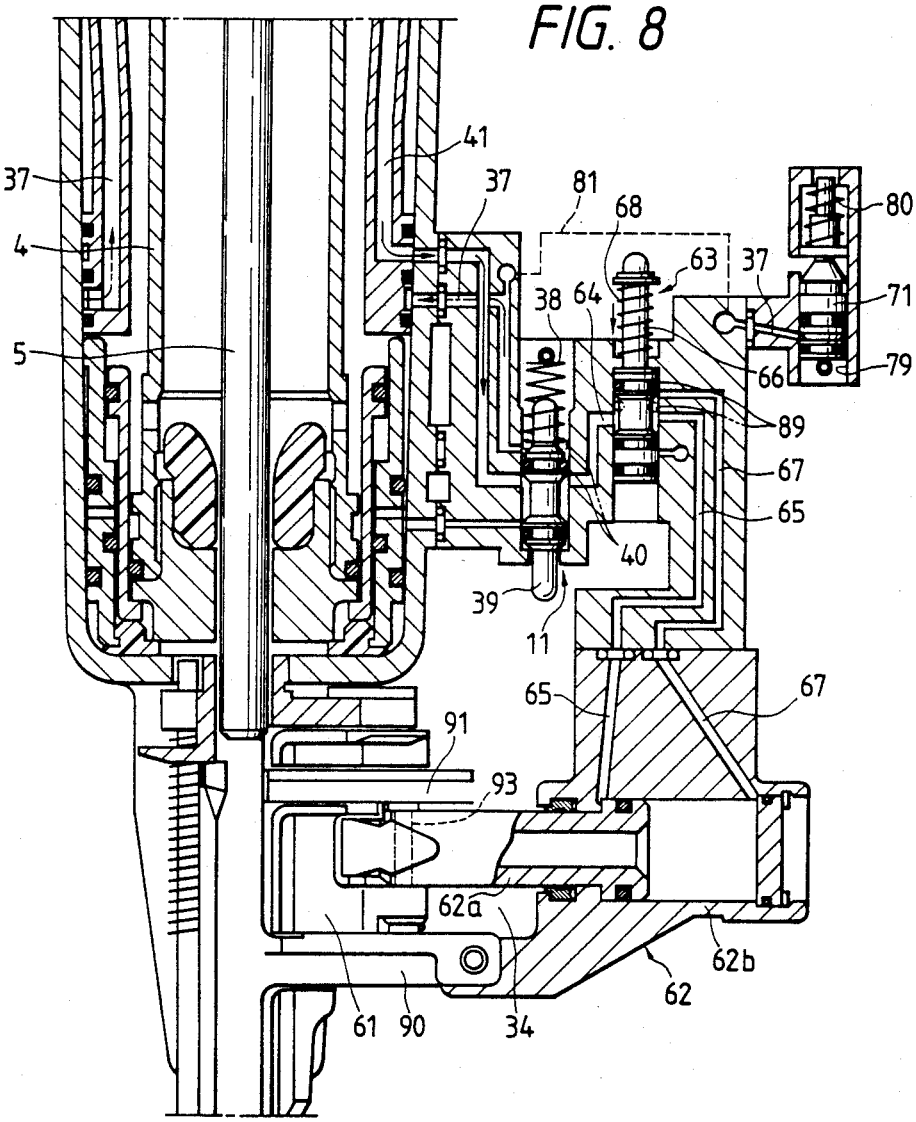
FIG. 8 a fragmentary cross-sectional view, showing a pneumatic circuit of the 4th embodiment.

Thus, the reaction load exerted on the housing 1 will not become zero, and therefore its vibration is represented as indicated in the solid line in FIG. 6. Therefore, the amplitude of the vibration imparted to the operator is small, and the discomfort and operating feeling of the operator can be greatly improved, and the operator safety can be secured.

In addition, by virtue of the provision of the pneumatically-operated mechanism, the force required to press the machine against the treating material 50 is reduced, and this lessens the fatigue of the operator.

Although the valve for controlling the supply of the compressed air to the pneumatically-operated mechanism is the trigger valve in the above embodiment, other types of valves may replace it.

A fourth embodiment of the invention relates to a nailing machine provided with a nail feed mechanism by which once a first nail is charged into the machine, the next nail will not be fed until the first nail is driven, thereby preventing the feeding of two nails at a time, and upon completion of the nailing operation, the nail feed mechanism is automatically returned to a feed-enabling condition so as to feed the next nail.

The fourth embodiment of the invention will now be described with reference to FIGS. 3B and 7 to 9.

Figure 9:
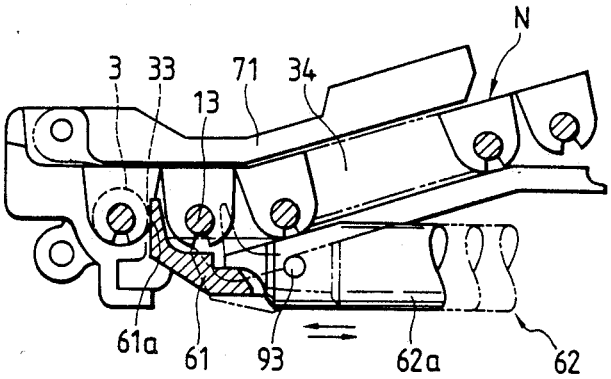
FIG. 9 is a view showing a nail feed mechanism of the 4th and 5th embodiments.
Figure 11:
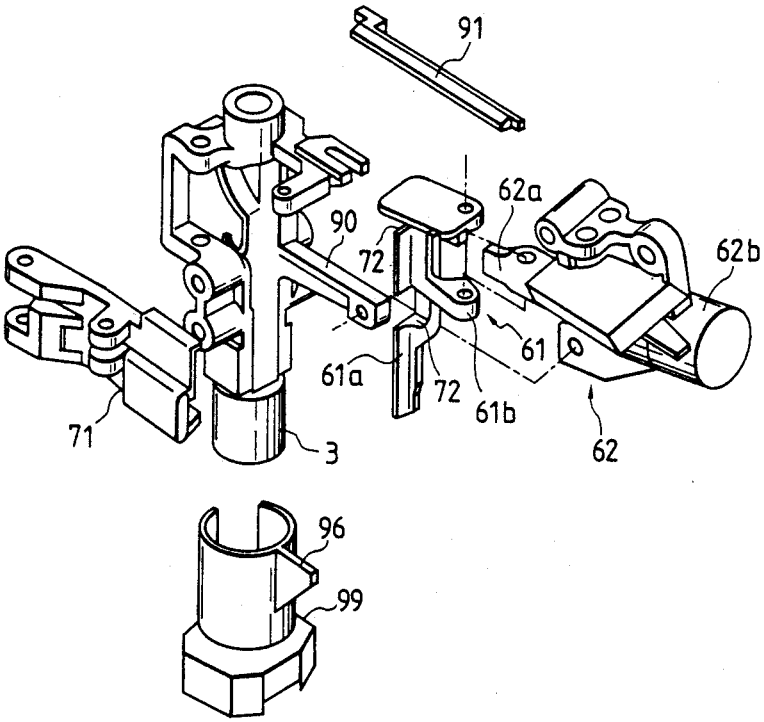
FIG. 11 is an exploded view of a main portion of the nail feed mechanism of the 5th embodiment.
Figure 10:
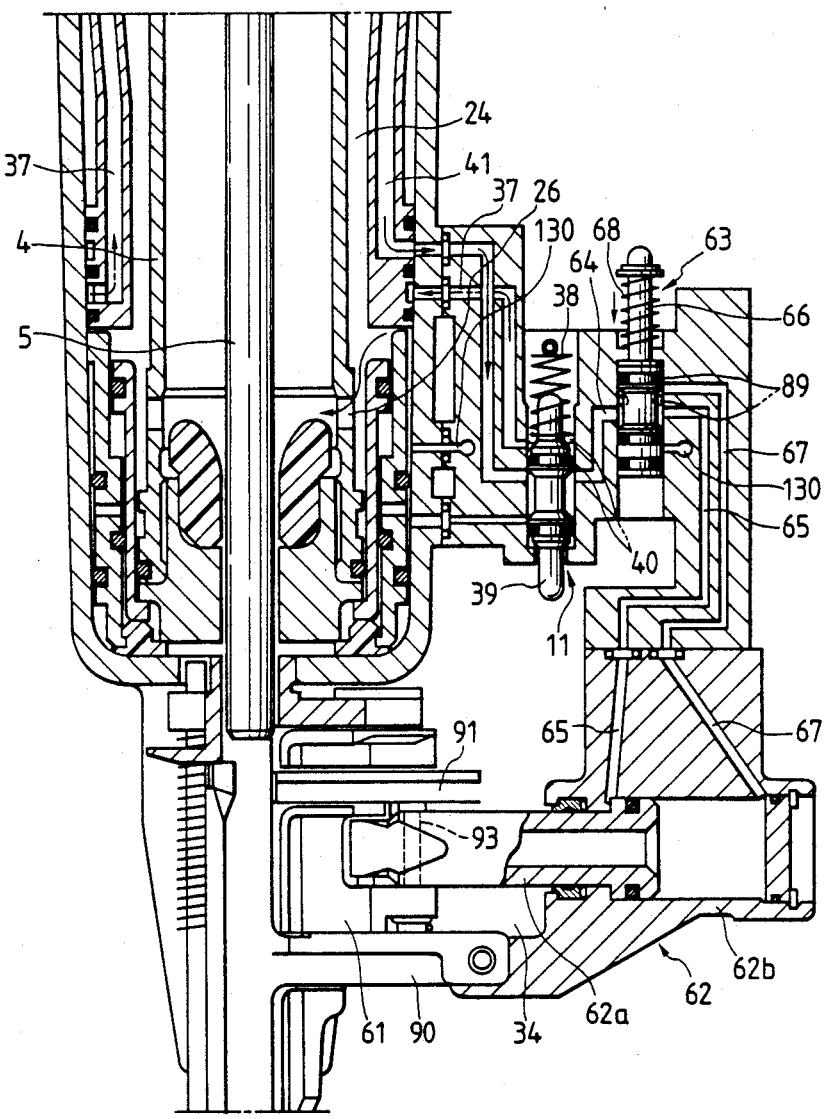
FIG. 10 is a view similar to FIG. 8 but showing the 5th embodiment.

The main construction and operation of the fourth embodiment are the same as those of the second embodiment described above, and explanation thereof will be omitted. As shown in FIG. 9, a nail feed mechanism for feeding nails to the ejecting member 3 from the magazine 12, provided in accordance with the fourth embodiment of the invention, comprises a nail feed member 61 reciprocally movable along the nail feed passage 34 opening to the nail supply port 33 formed in the side wall of the ejecting member 3, a piston and cylinder device 62 for driving the nail feed member 61, and a feed valve 63 for controlling the operation of the piston and cylinder device 62 comprising a feed piston 62*a* and a feed cylinder 62*b*.

The nail feed member 61 has a plate-like nail feed pawl 61*a* and is pivotally mounted on a front end of the feed piston 62*a* angular movement in a horizontal direction, the nail feed pawl 61*a* being spring-biased into the nail feed passage 34.

Figure 3B:
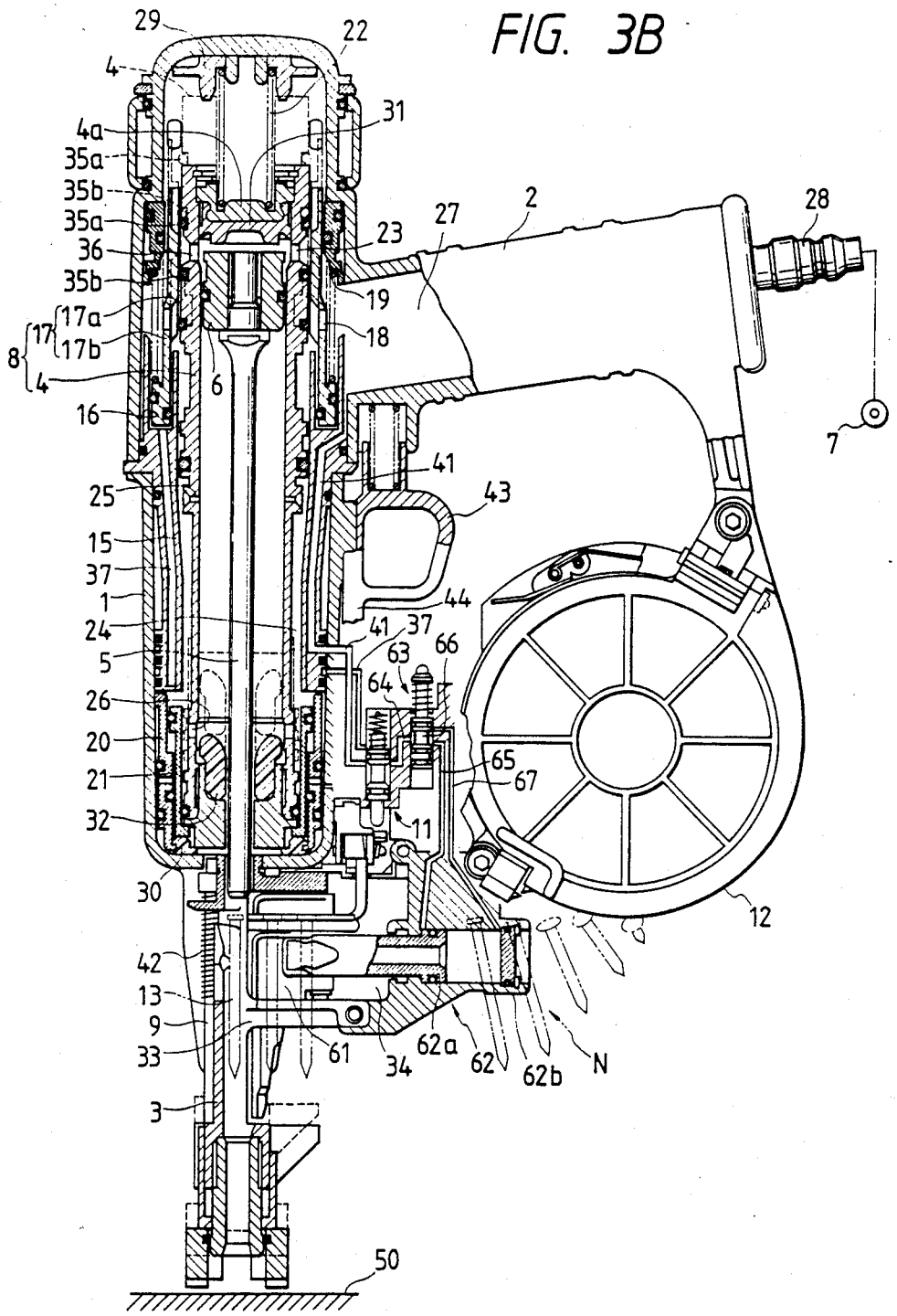

As shown in FIG. 3B, the feed valve 63 always connects an air passage 65, leading to the front end (left-hand end in FIG. 8) of a feed cylinder 62*b*), to the air chamber 27 of the grip portion 2 via an air passage 64, the trigger valve 11 and the air passage 41, and selectively connects an air passage 67, leading to the rear end (right-hand end) of the feed cylinder 62*b*, to the air chamber 27 via the air passage 64, the trigger valve 11 and the air passage 41 or to the atmosphere by means of a feed valve stem 66.

The feed valve stem 66 is urged by a spring 68 into the position where the air passage 67 leading to the rear end of the feed cylinder 62*b* is connected to the air passages 64 and 41 leading to the air chamber 27. In this position, the compressed air is introduced into the front and rear ends of the feed cylinder 62*b*, and due to a difference in effective pressure-receiving area between the front and rear ends of the feed piston 62*a*, the feed piston 62*a* is moved forwardly. On the other hand, when the feed valve stem 66 is pushed against the bias of the spring 68, the O-ring 89 is moved, so that the air passage 67 leading to the rear end of the feed cylinder 62*b* is communicated with the atmosphere. As a result, the compressed air in the air passage 67 is discharged, so that the feed piston 62*a* is moved rearwardly. At this time, the nail feed pawl 61*a* is moved rearwardly. At this time, the nail feed passage 34 against its urging force and is brought into engagement with the rear side of the shank portion of the leading nail 13 under its urging force, as indicated in a dot-and-dash line in FIG. 9. When the pushing force pushing the feed valve stem 66 against the bias of the spring 68 is released, the feed piston 62*a* is again moved forwardly toward the ejecting member 3, so that the nail feed pawl 61*a* moves the bundle of nails N along the nail feed passage 34, thereby feeding the above-mentioned nail 13 into the ejecting member 3. This operation is repeated to sequentially feed the nails into the ejecting member 3 through the nail supply port 33.

The nail feed mechanism is provided with a twice-feed prevention device which enables the feeding of the nail only when the nailing machine effects a nailing operation and prevents the feeding of the nails N twice.

Figure 7A:
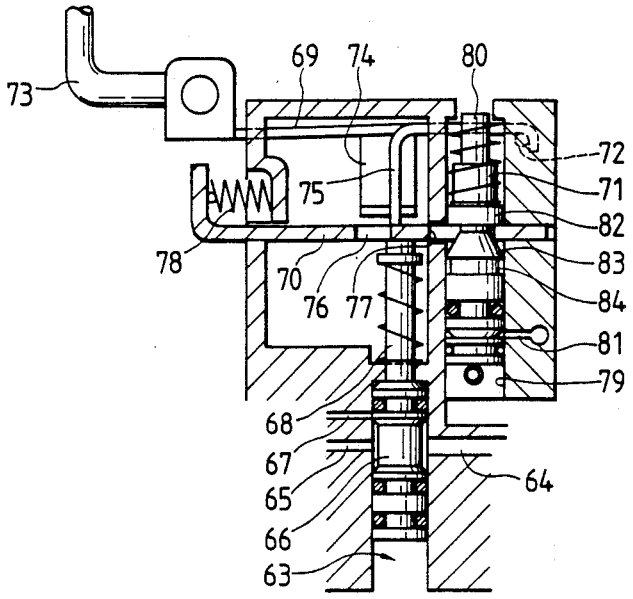
FIGS. 7(*a*) and (*b*) are cross-sectional views of a twice-feed prevention mechanism of the 4th embodiment of the invention, showing its operation.
Figure 7B:
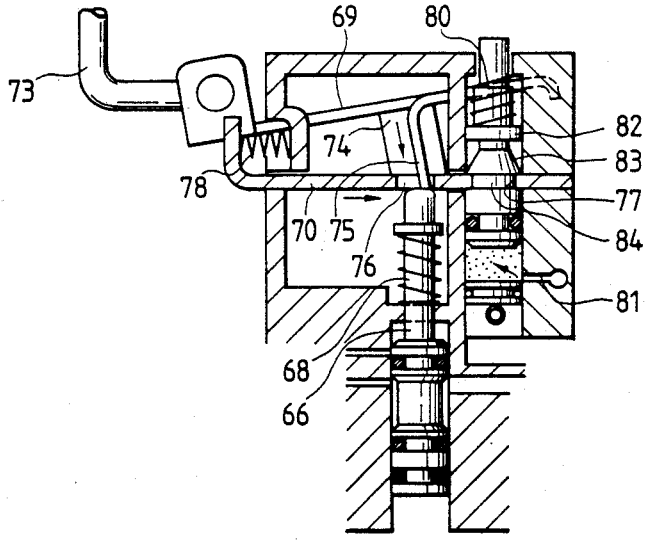

As shown in FIG. 7(*a*), the twice-feed prevention device comprises a feed lever 69 for operating the feed valve 63, a lock plate 70 for enabling and disenabling the operation of the feed lever 69, and a lock stem 71 for controlling the operation of the lock plate 70.

One end of the feed lever 69 is engaged with an engaging portion 72 of the housing 1, and the other end is connected to a feed arm 73 mounted on the grip portion 2. With this arrangement, the feed lever 69 is angularly movable about the one end thereof. The feed lever 69 has an engaging portion 74 for engagement with the upper end of the feed valve stem 66, and an angular movement prevention portion 75 in contact with the lock plate 70, these portions 74 and 75 being juxtaposed.

The lock plate 70 has a first through hole 76 for passing the angular movement prevention portion 75 of the feed lever 69, and a second through hole 77 through which the lock stem 71 extends. The lock plate 70 is movable relative to the housing 1 between a first position (FIG. 7(*a*)) where the angular movement prevention portion 75 is prevented from passing through the first hole 76 and a second position where the prevention portion 75 is allowed to extend through the first hole 76 so as to engage the engaging portion 74 with the feed valve stem 66. The lock plate 70 is normally urged by a spring 78 into the first position.

A lower portion of the lock stem 71 is received in a receptive portion 79 of the housing 1 so as to be slidingly movable upwardly and downwardly therealong, and the lock stem 71 is urged downwardly by a spring 80. An air passage 81 is branched off from the air passage 37 leading to the head valve 17, and opens to the lower end portion of the receptive portion 79 . With this arrangement, when the compressed air is supplied to the air passage 81 (that is, the nailing machine is operated), the lock stem 71 is moved upwardly against the bias of the spring 80. The lock stem 71 has a throttle portion 82 formed at its central portion and having a tapered surface 83 and a receiving groove 84 below the tapered surface 83. The lock stem 71 extends through the second hole 77 in such a manner that the throttle portion 82 is disposed in the second hole 77.

With the above construction, when the lock plate 70 is in its first position (FIG. 7(*a*)), even if the feed arm 73 is pushed down, the feed lever 69 is prevented from angular movement since the angular movement prevention portion 75 is held against the lock plate 70, so that the feed valve 66 can not be operated.

On the other hand, when the trigger valve stem 39 is pushed upwardly, the compressed air is supplied to the air passage 37 so as to operate the head valve 17 to thereby repeatedly operate the nailing machine. At this time, the compressed air is supplied from the air passage 37 to its branched air passage 81 to upwardly move the lock stem 79. As a result, the tapered surface 83 in contact with the right-hand portion (FIG. 7) of the edge of the second hole 77 urges the lock plate 70 to move in the right-hand direction against the bias of the spring 78, so that the lock plate 70 is moved to its second position (FIG. 7(*a*)) where the edge of the second hole 77 is received in the receiving groove 84 to hold the lock plate 70 in its second position. When the pushing of the trigger valve stem 39 is released, the operation of the nailing machine is stopped, and at the same time the compressed air supplied to the air passage 81 is discharged. However, the lock stem 79 is still held in its upper position through the engagement of the receiving groove 84 in the second hole 77.

When the lock plate 70 is in its second position, the first hole 76 is in registry with the distal end of the angular movement prevention portion 75. In this condition, when the feed arm 73 is pushed down, the angular movement prevention portion 75 is inserted in the first hole 76 of the lock plate 70, so that the feed lever 69 is angularly moved. As a result, the engaging portion 74 is moved downwardly into engagement with the feed valve stem 66 to push it down whereby the nail feed mechanism is operated to feed the nails as described above.

As described above, the feed lever 69 is angularly moved by pushing down the feed arm 73, and the angular movement prevention portion 75 passing through the first hole 76 as a result of this angular movement further moves the lock plate 70 beyond its second position as indicated in an arrow in FIG. 7(*b*), so that the engagement of the edge of the second hold 77 in the receiving groove 84 of the lock stem 71 is released. As a result, the lock stem 71 is returned downwardly under the influence of the spring 80. When the finger is removed from the feed arm 73, the feed lever 69 is moved upwardly, and then when the angular movement prevention portion 75 is withdrawn from the first hole 76, the lock plate 70 is returned to its first position under the influence of the spring 78.

As described above, when the lock plate 70 is in its first position, the feed lever 69 can not engage the feed valve stem 66, so that the feed valve stem 66 can not be operated.

The lock stem 71 is moved by the compressed air fed during the operation of the nailing machine, so that the lock stem 71 forcibly moves the lock plate 70 into its second position and hold it in this position. In this condition, the feed lever 69 is engageable with the feed valve stem 66 by manipulating the feed arm 73 to effect the nail feed operation. And, as a result of this manipulation of the feed arm 73, the locking engagement of the lock stem 71 with the lock plate 70 is released, and the lock stem 66 is returned to its initial position, and the lock plate 70 is also returned to its first position to again prevent the feed lever 69 from engaging the feed valve stem 66.

The nail feed operation can be carried out easily by one hand, that is, by pushing the feed arm 73 mounted on the grip portion 2.

Once the nail feed mechanism is operated, the feed lever 69 is prevented from angular movement as a result of this operation of the nail feed mechanism, so that the nail feed mechanism can not be operated again. Therefore, the jamming of the nails in the nailing machine as well as damage to the component parts are positively prevented.

When the trigger valve 39 is pushed upwardly to operate the nailing machine, the lock stem 71 is moved to maintain the lock plate 70 in its second position (lock release position), so that the nail feed mechanism is returned to the condition to enable the next nail feed operation. Therefore, there is no need to provide any special mechanism and operation for releasing the lock.

If for some reason, the lock stem 71 or the feed lever 69 is locked, this lock can be released by pushing the end of the lock plate 70.

In the above fourth embodiment, although the twice-feed prevention mechanism is applied to the nailing machine of the repeatedly-operating type, it can be applied to a nailing machine of the type in which a striking driver is caused to strike against the nail only once.

A fifth embodiment of the invention relates to a safety mechanism for a nailing machine in which mechanism the contact member and the nail feed member cooperate with each other so as to allow the nailing operation only when the nail is properly fed into the ejecting member, and the nail is prevented from ejecting from the nail supply port when the nailing machine is operated.

In the fourth embodiment described above, the nail feed member 61 has the nail feed pawl 61*a* disposed in engagement with the rear side of the shank portion of the leading nail 13. After the nail feed pawl 61*a* feeds the nail 13 into the ejecting member 3, the pawl 61*a* closes the nail supply port 33 to thereby prevent the nail from ejecting from the nail supply port 33 when the nail is struck by the striking driver 5.

However, when the nail feed operation fails to be properly effected due for example to the jamming of the nail in the nail feed passage 34 or the feeding of two nails into the ejecting member 3, the nail feed pawl 61*a* can not be moved to the position to close the nail supply port 33, so that there is a risk that the nail within the ejecting member 3 may be ejected from a space between the nail supply port 33 and the nail feed pawl 61*a*.

The nail feed member 61 is normally urged by a spring or air pressure into the position where it feeds the nail into the ejecting member 3, and is angularly movable into and out of the nail feed passage 34, the nail feed member 61 being spring urged into the nail feed passage 34. There are occasions when the nail struck by the striking driver 5 within the ejecting member 3 is caused to strike the nail feed member 61 with a substantial force to thereby push it back against the spring biasing force. In this case, a space develops between the nail feed member 61 and the nail supply port 33, and as a result there is a risk that the struck nail may be ejected from this space.

The fifth embodiment of the invention seeks to provide a safety mechanism which overcome the above difficulties, and disenables the nailing operation if the nail is not properly fed by the nail feed member, and prevents the nail, struck within the ejecting member, from ejecting from the nail supply port even if the normal nail feed operation is carried out.

The fifth embodiment of the invention will now be described with reference to FIGS. 3A, 5 and 9 to 11. The main construction and operation of the fifth embodiment are the same as those of the fourth embodiment described above. Therefore, explanation thereof will be omitted.

In the fifth embodiment, the contact member 9 has a contact arm 98, and an annular portion 99 disposed in surrounding relation to a bulged front portion 3*a* of the ejecting member 3, the annular portion 99 being slidingly movable along the axis of the ejecting member 3. The contact arm 98 is engaged with the annular portion 99, and is urged by a spring 42 in such a manner that the front end of the annular portion projects from the front end of the ejecting member 3.

Although the contact member 9 comprises the separate contact arm 98 and annular portion 99 in this embodiment, the invention is not to be restricted to this arrangement, and they may be formed integrally with each other, or the contact member may comprises more than two parts.

The nail feed passage 34 is formed by a guide lever 90 formed on the ejecting member 3 on the side of the nail supply port 33 and extending toward the nail supply magazine, and a door member 71 disposed in opposed relation to the guide lever 90 and spaced therefrom a distance corresponding to the width of the bundle of nails N. An upper guide member 91 is disposed above the guide lever 90 in parallel relation thereto.

The feed piston and cylinder device 62 comprises the feed cylinder 62*a* fixed between the guide lever 90, forming one side of the nail feed passage 34, and the nail supply magazine. The feed piston 62*a* is received within the feed cylinder 62*b* for movement therealong. The nail feed member 61 has a connecting portion 61*b* pivotally connected to the front end of the feed piston 62*b* by a pivot pin 93 for angular movement, and the plate-like nail feed pawl 61*a* having a length generally equal to the length of the shank of the nails N. The feed pawl 61*a* has grooves 72 for receiving the guide lever 90 and the guide member 91. A spring is mounted on the pivot pin 93 so as to urge the feed pawl 61*a* into the nail feed passage 34. The nail feed member 61 is reciprocally movable along one side of the nail feed passage 34 in accordance with the movement of the feed piston 62*a*.

If the striking driver 5 is positioned in the ejecting member 3, the nail feed operation can not be carried out. Therefore, an air chamber 130 leading to the return air chamber 24 is opened to the feed valve 63, and when the feed valve 63 is operated, the air passage 130 is connected to the air passage 64, and the compressed air within the air chamber 27 is supplied into the movable cylinder 4 via the return air chamber 24 and the aperture 26 to positively return the striking piston 6 into its initial position.

When the feed pawl 61*a* is moved toward the ejecting member 3, its front end feeds the leading nail 13 into the ejecting member 3 through the nail supply port 33 and generally entirely closes the nail supply port 33.

The contact member 9 has a receptive portion 95 formed between the annular portion 99 and the ejecting member 3. When the contact member 9 is moved upwardly relative to the ejecting member 3, the receptive portion 95 receives the lower end portion of the feed pawl 61*a* closing the nail supply port 33, thereby preventing the movement of the feed pawl 61*a*, as shown in FIG. 3A.

The annular portion 99 has a projection 96 which engages the feed pawl 61*a* except when the feed pawl 61*a* is in the position to close the nail feed port 33, thereby preventing the sliding movement of the contact member 9.

With the above construction, when the nail feed member 61 engages and properly feeds the nail N within the nail feed passage 34, the feed pawl 61*a* closes the nail supply port 33 of the ejecting member 3 after it feeds the nail into the ejecting member 3. At this time, when the contact member 9 is pressed against the treating material 50 so as to effect the nailing operation, the contact member 9 is moved upwardly relative to the ejecting member 3, so that the front end of the feed pawl 61*a* is received in the receptive portion 95. Therefore, the nailing machine can be operated through the cooperation of the contact member 9 with the trigger mechanism 11. Even if there develops any force tending to eject the nail, struck by the striking driver 5, from the nail supply port 33, this will be prevented, because the front end of the feed pawl 61*a* is received and held in the receptive portion 95 to prevent the angular movement of the nail feed member 61 to keep the nail supply port 33 positively closed by the feed pawl 61*a*.

And, if the nail feed operation is not effected properly due to the jamming of the nail in the nail feed passage 34 or the twice feeding of the nails, the feed pawl 61*a* can not be moved to the position to close the nail supply port 33. Therefore, even if the nailing operation is intended to be carried out, this can not be done, because the feed pawl 61*a* is engaged with the projection 96 to prevent the contact member 9 from slidingly moving sufficiently, so that the contact member 9 and the trigger member 1 can not cooperate to operate the nailing machine.

A sixth embodiment of the invention relates to a nail charging mechanism for a nailing machine which is capable of enlarging the space within the nail feed passage to thereby facilitating the charging of a bundle of nails into the nail feed passage.

The sixth embodiment of the invention will now be described with reference to FIGS. 3A and 12 to 16.

Figure 14:
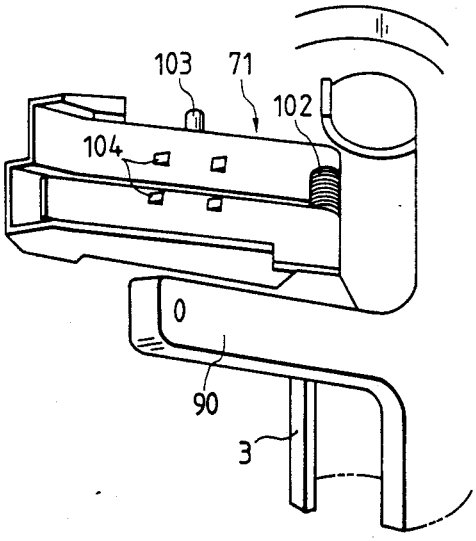
FIG. 14 is a view similar to FIG. 13 but seen from the other side.
Figure 15:
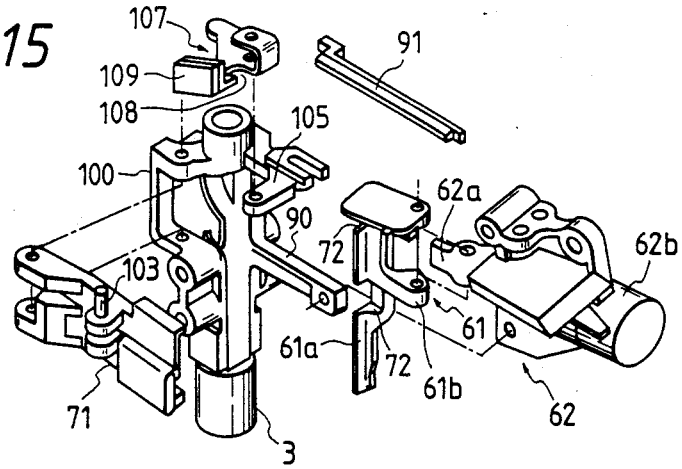
FIG. 15 is an exploded view of a portion of the nail feed mechanism.

The main portion and construction of the sixth embodiment are the same as those of the fifth embodiment described above. Therefore, explanation thereof will be omitted. The ejecting member 3 has a support portion 100 disposed on the opposite side of the nail feed passage 34, that is, on the opposite side of the nail feed member 61 (FIG. 15). A door member 71 is mounted on the support portion 100 for angular movement between its open and closed positions. The door member 71 is urged by a spring 102 toward its open position as shown in FIG. 14. The door member 71 has an engaging projection 103 formed at a central portion thereof and projecting upwardly, the door member 71 having claws 104 on a face thereof facing the nail feed passage 34.

Figure 12:
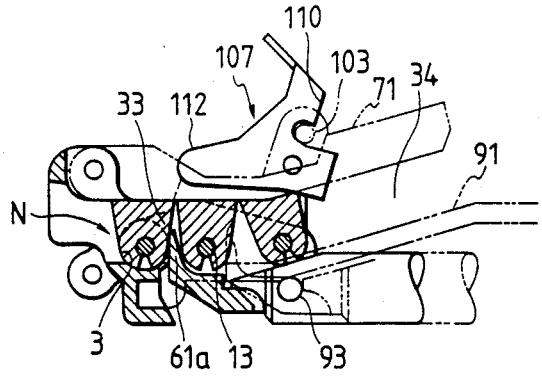
FIG. 12 is view of a portion of a nail feed mechanism of a 6th embodiment.
Figure 13:
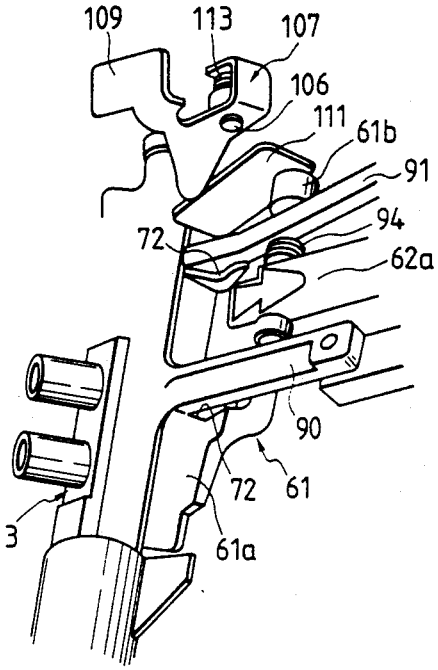
FIG. 13 is a perspective view of a portion of the nail feed mechanism as seen from one side.

As shown in FIGS. 12, 13 and 15, the ejecting member 3 has a mounting portion 105 extending from an upper end thereof toward the nail feed passage 34 and disposed above it. A door operating lever 107 is pivotally mounted on the mounting portion 105 by a pivot pin 106. The door operating lever 107 has an engaging notch 108 in which the engaging projection 103 of the door member 71 is engaged, when the door member 71 is in its closed position, so as to retain the door member 71 in its closed position. The door operating lever 107 also has an operating portion 109 for releasing the engagement of the notch 108 with the projection 103. The door operating lever 107 has a engaging surface 110 which is engaged with the engaging projection 103 of the door member 71 when the above engagement is released, so as to hold the door member 71 in its open condition, the door operating lever 107 having a cam surface 112 which is engaged with a contact plate 111 of the nail feed member 61 during the angular movement of the door operating lever 107 so as to retract the nail feed member 61 from the nail feed passage 34. The door operating lever 107 is normally urged by a spring 113 in a direction to engage the engaging projection 103 of the door member 71.

Figure 16A:
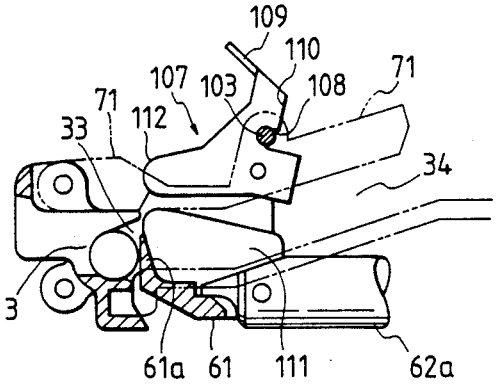
FIGS. 16(*a*) and (*b*) are views of a portion of a nail charging mechanism, showing its operation.
Figure 16B:
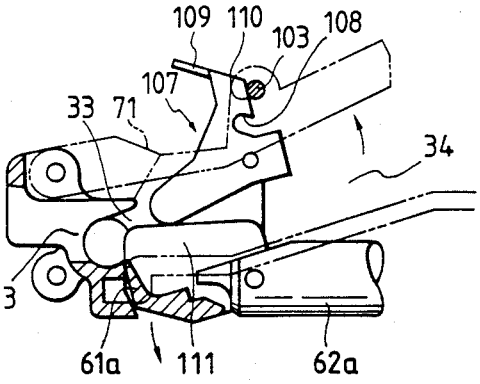

The arrangement of the nail feed member 61, the door member 71 and the door operating lever 107 is shown in FIG. 16(*a*).

With this construction, for charging the bundle of nails into the nail feed passage 34, the operating portion 109 is pushed by the finger to angularly move the door operating lever 107, so that the engagement of the engaging projection 103 with the engaging notch 108 is released, as shown in FIG. 16(*b*). Upon release of this engagement, the door member 71 is angularly moved into its open position under the influence of the spring 102 (FIG. 14), so that the engaging projection 103 is brought into engagement with the engaging surface 110 of the door operating lever 107. As a result, the door member 71 is held in its open position, and the door operating lever 107 is prevented from angular movement, that is, held in this position. When charging the bundle of nails, the nail feed member 61 is positioned in the vicinity of the ejecting member 3. Therefore, upon angular movement of the door operating lever 107, the cam surface 112 is engaged with the contact plate 111 on the upper end of the nail feed member 61 and pushes it, so that the nail feed member 61 is angularly moved against the bias of a spring 94 (FIG. 13). As a result, the nail feed pawl 61*a* is retracted from the nail feed passage 34 and is maintained in this condition through the engagement of engaging surface 110 of the door operating lever 107 with the engaging projection 103 of the door member 71. In this manner, the door member 71 which has closed the nail feed passage 34 is opened, and the the nail feed pawl 61*a* is retracted from the nail feed passage 34, so that the space within the nail feed passage 34 becomes larger. Therefore, by an easy manipulation, that is, by angularly moving the door operating lever 107, the bundle of nails can be charged into the nail feed passage 34 easily and quickly. And, the bundle of nails can be removed from the nail feed passage 34 with ease.

When the door member 71 is angularly moved toward its closed position after the bundle of nails is charged, the engaging projection 103 of the door member 71 slides along the engaging surface 110 of the door operating lever 107. Then, when the door member 71 is moved into its closed position, the engaging projection 103 becomes engaged in the engaging notch 108 of the door operating lever 107, so that the door member 71 is locked in its closed position. At this time, the nail feed pawl 61*a* is introduced into the nail feed passage 34, as shown in FIG. 16(*a*).

In the above nail charging mechanism, the nail feed member 61 is not retracted utilizing the spring forces acting on the the door member 71 and door operating lever 107, but it is retracted and retained in its retracted position through the engagement of the door operating lever 107 with the door member 71. Therefore, there is no need to use large springs for the door member 71 and door operating lever 107, and these can be operated easily.

Although the above nail charging mechanism is used in the nailing machine of the repeatedly operating type, it can also be applicable to a nailing machine of the type in which the nail in the ejecting member is struck by the striking driver only once.

What is claimed is:

1. A percussion tool of the repeatedly operating type which comprises:

(a) an elongated housing;

(b) a tubular ejecting member extending from a lower end of said housing and adapted to receive a driven element therein;

(c) a striking cylinder having upper and lower closed ends and received within said housing for movement therealong between an upper and a lower position, said striking cylinder being spring-urged into its lower position toward said ejecting member;

(d) a striking piston received within said striking cylinder for sliding movement therealong toward and away from said ejecting member, said striking piston having a striking driver mounted thereto and slidably extending through the lower end of said striking cylinder and being extendable into said ejecting member, said striking cylinder cooperating with said housing to provide an automatic switch valve means which is responsive to the movement of said striking cylinder along said housing for selectively communicating the interior of said striking cylinder with a compressed air source to move said striking piston to cause said striking driver to strike said driven element and for selectively communicating said interior with the ambient atmosphere;

(e) a contact member movable between an upper and a lower position and spring-urged into its lower position where said contact member projects downwardly from a lower end of said ejecting member; and (f) a trigger means for actuating said switch valve means so as to communicate the interior of said striking cylinder with said compressed air source, said trigger means including a contact lever manually operable to be moved into its operative position, said contact member being engageable with said contact lever to move said contact lever to said operative position so as to actuate said switch valve.

2. A percussion tool according to claim 1, in which said switch valve means includes an air supply and discharge port formed through said striking cylinder adjacent to the upper end of said striking cylinder, a pair of sealing means mounted on the outer periphery of said striking cylinder and disposed on opposite sides of said air supply and discharge port and a sleeve-shaped head valve reciprocally mounted within said housing and having apertures communicating with said compressed air source, wherein said head valve is reciprocally movable along the inner peripheral surface of said housing between an operable position keeping a state that the apertures is not communicated with said air supply and discharged port and a non-operable position keeping a state that the apertures is communicated with said air supply and discharged port, wherein said trigger means supplies said compressed air from said compressed air source to said head valve to move said head valve from said non-operable position thereof to said operable position.

3. A percussion tool according to claim 1, in which part of said contact member extends into said housing and is disposed in opposed relation to the lower end of said striking cylinder; upon pressing of a lower end of said contact member against a material into which said driven element is to be driven, said contact member being moved upwardly relative to said housing so as to engage said part with the lower end of said striking cylinder which is moved to its lower position, to thereby support said striking cylinder in such a manner that said striking cylinder is spaced from the lower end of said housing.

4. A percussion tool according to claim 1, in which part of said contact member extends into said housing and is disposed in opposed relation to the lower end of said striking cylinder; upon pressing of a lower end of said contact member against a material into which said driven element is to be driven, said contact member being moved upwardly relative to said housing so as to engage said part with the lower end of said striking cylinder which is moved to its lower position, to thereby move said striking cylinder to the upper position of said contact member so as to space striking cylinder from the lower end of said housing; there being provided a pneumatically-operated mechanism for pneumatically moving said movable cylinder to the upper position of said contact member; and there being provided a control valve means for operating said pneumatically-operated mechanism so as to move said movable cylinder to the upper position of said contact member before said percussion tool is operated.

5. A percussion tool according to claim 4, in which said pneumatically-operated mechanism comprises a movable sleeve mounted around said movable cylinder for sliding movement therealong and having an engaging portion for engagement with a part of said movable cylinder and a control valve means for supplying said compressed air from said compressed air source to said movable cylinder when said tool is not operated, so that said movable cylinder is moved to said upper position of said contact member by said engaging portion before said tool is operated.

6. A percussion tool of the repeatedly operating type which comprises:

(a) an elongated housing having at its lower end portion a tubular ejecting portion adapted to receive a driven element, said housing having at its upper end portion a discharge port;

(b) a striking cylinder having upper and lower closed ends and received within said housing for movement therealong between an upper and a lower position, said striking cylinder being spring-urged into its lower position toward said ejecting portion;

(c) a striking piston received within said striking cylinder for sliding movement therealong toward and away from said ejecting portion, said striking piston having a striking driver mounted thereto and slidably extending through the lower end of said striking cylinder and being extendable into said ejecting portion, said piston having a lower face in facing relation to said ejecting portion, and a return air chamber disposed between said striking cylinder and said housing and communicating with that portion of the interior of said striking cylinder disposed between said lower face of said striking piston and the lower end of said striking cylinder;

(d) said striking cylinder cooperating with said housing to provide a switch valve means which is responsive to the movement of said striking cylinder along said housing for selectively interrupting fluid communication between the interior of said striking cylinder and said discharge port and communicating the interior of said striking cylinder with a compressed air source when said striking cylinder is at its lower position to thereby move said striking piston to cause said striking driver to strike said driven element and for selectively interrupting the communication between the interior of said striking cylinder and said compressed air source and communicating the interior of said striking cylinder with said discharge port as said striking cylinder is moved from its lower to upper position, and air within said that portion of the interior of said striking cylinder being compressed by said striking piston moving toward said ejecting portion and being supplied to said return air chamber, said air thus compressed acting on said lower face of said piston to urge the same away from said ejecting portion.

7. A percussion tool according to claim 6, in which said switch valve means comprises an air supply and discharge port formed through said striking cylinder adjacent to the upper end of said striking cylinder, a pair of sealing means mounted on the outer periphery of said striking cylinder and disposed on opposite sides of said air supply and discharge port and a sleeve means mounted on the inner peripheral surface of said housing and having apertures communicating with said air supply source, wherein one of said sealing means communicates said air supply and discharge port with said apertures while said striking cylinder moves from its upper dead point toward its lower dead point and the other one of said sealing means communicates said air supply and discharge port with said apertures while said striking cylinder moves from its lower dead point toward its upper dead point.

8. A percussion tool according to claim 7, further comprising a trigger valve means for selectively communicating said compressed air source to said switch valve means.

* * * * *